United States Patent [19]

Brandell

[11] Patent Number: 4,961,465

[45] Date of Patent: Oct. 9, 1990

[54] CASING PACKER SHOE

[75] Inventor: John T. Brandell, Duncan, Okla.

[73] Assignee: Halliburton Company, Duncan, Okla.

[21] Appl. No.: 384,048

[22] Filed: Jul. 24, 1989

Related U.S. Application Data

[63] Continuation of Ser. No. 257,172, Oct. 11, 1988, abandoned, which is a continuation of Ser. No. 25,048, Mar. 12, 1987, abandoned.

[51] Int. Cl.[5] ..... E21B 33/124; E21B 33/126

[52] U.S. Cl. ..... 166/184; 166/191; 166/202

[58] Field of Search ..... 166/202, 184, 185, 242, 166/153, 156, 285, 291, 277, 191

[56] References Cited

U.S. PATENT DOCUMENTS

| | | | |
|---|---|---|---|
| 1,563,162 | 11/1925 | Christenson | 166/191 |
| 2,200,943 | 5/1940 | Wilson et al. | 166/184 |
| 2,305,282 | 12/1942 | Taylor, Jr. et al. | 166/202 |
| 2,546,978 | 4/1951 | Collins et al. | 166/202 |
| 2,585,706 | 2/1952 | Ware | 166/191 |
| 2,602,511 | 7/1952 | Johnson | 166/202 |
| 2,672,199 | 3/1954 | McKenna | 166/202 |
| 2,674,315 | 4/1954 | Brown | 166/202 |
| 2,813,589 | 11/1957 | Woodruff | 166/285 |
| 2,829,717 | 4/1958 | Brown | 166/202 |
| 3,010,518 | 11/1961 | Harmon | 166/202 |
| 3,131,767 | 5/1964 | Chancellor et al. | 166/156 |
| 3,391,743 | 7/1968 | Bateman | 166/184 |
| 3,524,503 | 8/1970 | Baker | 166/289 |
| 3,527,299 | 9/1970 | Lewis | 166/184 |
| 4,149,566 | 4/1979 | Stowe | 166/202 |
| 4,407,369 | 10/1983 | Hutchison et al. | 166/291 |
| 4,431,058 | 2/1984 | Spencer et al. | 166/184 |
| 4,469,174 | 9/1984 | Freeman | 166/202 |

*Primary Examiner*—Bruce M. Kisliuk

*Attorney, Agent, or Firm*—James R. Duzan; E. Harrison Gilbert, III

[57] ABSTRACT

A cup type formation packer shoe is provided to be used in well cementing operations for cementing either casing or tubing in existing casing in a well bore. This packer shoe includes packer cups which are forced into sealing engagement with the existing casing by the cement being displaced into the annulus between the existing casing and the new casing. Further, the packer cups support the column of cement in the annulus preventing flow downwardly past the packer shoe.

12 Claims, 2 Drawing Sheets

CASING PACKER SHOE

This is a continuation of application Ser. No. 07/257,172 filed on Oct. 11, 1988 now abandoned, which is a continuation of application Ser. No. 07/025,048 filed on Mar. 12, 1987, now abandoned.

BACKGROUND OF THE INVENTION

This invention relates to a cup type formation packer shoe to be used in cementing wells. In wells for the production of oil and gas the casing cemented into the bore hole will wear out and leak due to corrosion, wear from various well operations, etc. and need to be repaired. The casing is then typically repaired by cementing a smaller string of casing inside the first.

When cementing the smaller string of casing in the first, it is common to use a formation packer shoe on the bottom of the smaller string of casing to control the cement during the cementing operation. Such a typical prior art formation packer shoe is shown and described in Halliburton Services Sales and Service Catalog, Number 43 on pages 2437, 2438 and 2439 therein.

However, in wells which have a low level of fluid therein and in which it is desired to cement a full string of smaller casing in the well to repair the existing casing in the well, the differential pressure across the packer portion of the formation packer shoe often exceeds the typical 1000 psi differential pressure rating of the packer on the inflatable packer shoe. In these wells it is necessary to use a formation packer shoe which will withstand the higher differential fluid pressures necessary to cement the full string of casing in the existing casing in a single operation.

STATEMENT OF THE INVENTION

The present invention is directed to a cup-type formation packer shoe to be used in well cementing operations. The cup-type formation packer shoe may be used on either casing or tubing as needed.

The advantages of the invention will become apparent as the following detailed description of the preferred embodiments is read in conjunction with the accompanying drawings which illustrate such preferred embodiments.

DETAILED DESCRIPTION OF THE INVENTION

Figure 1:
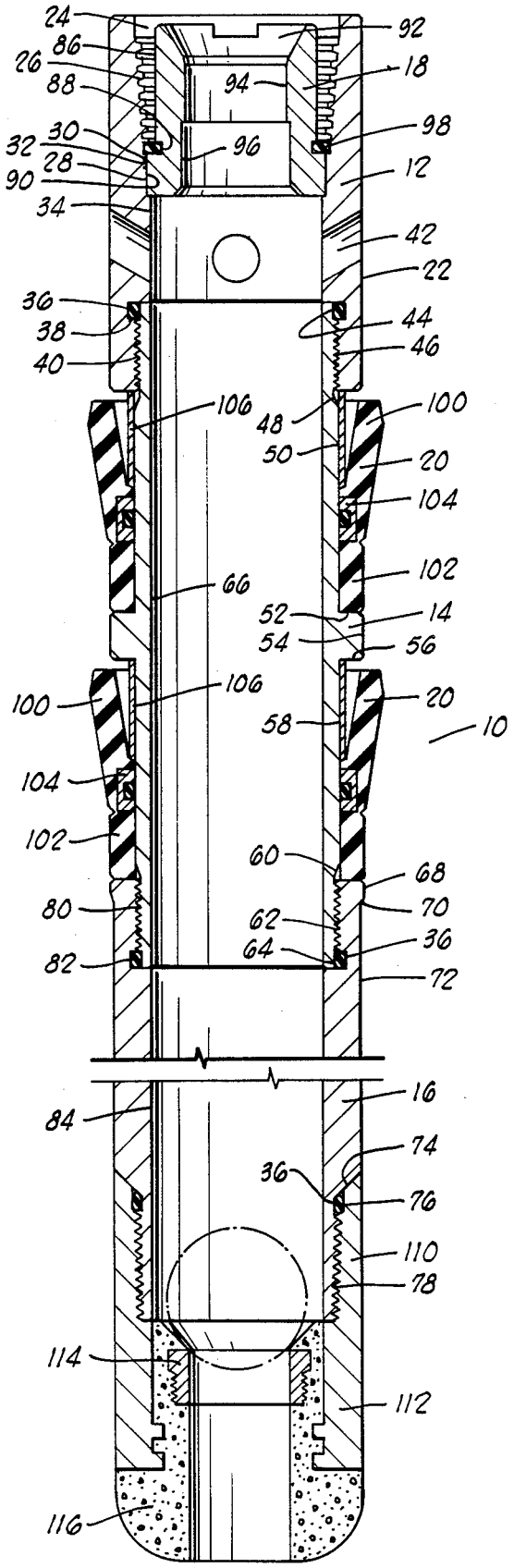
FIG. 1 is a cross-sectional view of the cup type formation packer shoe of the present invention for use in cementing a smaller diameter string of casing within a larger diameter string of casing.

Referring to FIG. 1, the cup type formation packer shoe 10 of the present invention is shown in its preferred embodiment for use in cementing a smaller diameter string of casing within a larger diameter string of existing casing 8.

The cup type formation packer shoe 10 comprises an upper adapter 12, cup housing 14, lower adapter 16, landing nipple 18 and packer cups 20.

The upper adapter 12 comprises an elongated single-body annular cylindrical member having a cylindrical exterior surface 22 and, on the interior, first bore 24, first threaded bore 26, second bore 28 having, in turn, annular recess 30 therein containing elastomeric annular seal 32, third bore 34, annular seal recess 36 containing annular elastomeric seal 38 therein and second threaded bore 40. The upper adapter 12 further includes a plurality of holes or apertures 42 therethrough.

The cup housing 14 comprises an elongated single-body annular cylindrical member having, on the exterior thereof, first cylindrical seal surface 44, first threaded surface 46 which threadedly engages second threaded bore 40 of upper adapter 12, first frusto-conical surface 48, first cylindrical cup surface 50, first annular shoulder 52, intermediate cylindrical surface 54, second annular shoulder 56, second cylindrical cup surface 58, second frusto-conical surface 60, second threaded surface 62 and second cylindrical seal surface 64 and, on the interior thereof, bore 66.

The lower adapter 16 comprises an elongated single-body annular cylindrical member having, on the exterior thereof, first cylindrical surface 68, first frusto-conical surface 70, second cylindrical surface 72, second frusto-conical surface 74, cylindrical seal surface 76 and threaded surface 78 and, on the interior thereof, threaded bore 80 which threadedly engages second threaded surface 62 of cup housing 14, cylindrical seal bore 82 and bore 84.

Additional annular elastomeric seals 36 are used to seal between the cup housing 14 lower adapter 16 and any desired float shoe secured to the end of lower adapter 16.

The landing nipple 18 comprises an annular cylindrical member having, on the exterior thereof, first cylindrical surface 86 having, in turn, annular recess 88 therein, and second cylindrical surface 90 and, on the interior thereof, frusto-conical bore 92, first bore 94 and second bore 96. The landing nipple 18 is threaded in position in the upper adapter 12 and has resilient seal 98 therein. The cup 20 comprises an annular elastomeric generally cylindrical member having a cup lip portion 100, cup base portion 102 and annular reinforcement 104.

Each cup 20, is retained on cup housing 14 having cup spacer 106 abutting the bottom of the interior of the cup lip portion 100 while the other end of cup spacer 106 abuts either the end of upper adapter 12 or annular shoulder 56 of cup housing 14. Similarly, each cup 20 has the other end thereof abutting either annular shoulder 52 of cup housing 14 or, the upper end of bottom adapter 16.

As further shown in FIG. 1, a float shoe 110 is threadedly secured to threaded surface 78 of lower adapter 16. The guide shoe 110 comprises an annular cylindrical housing 112 having a ball seat 114 retained therein by cementitious material 116.

Figure 2:
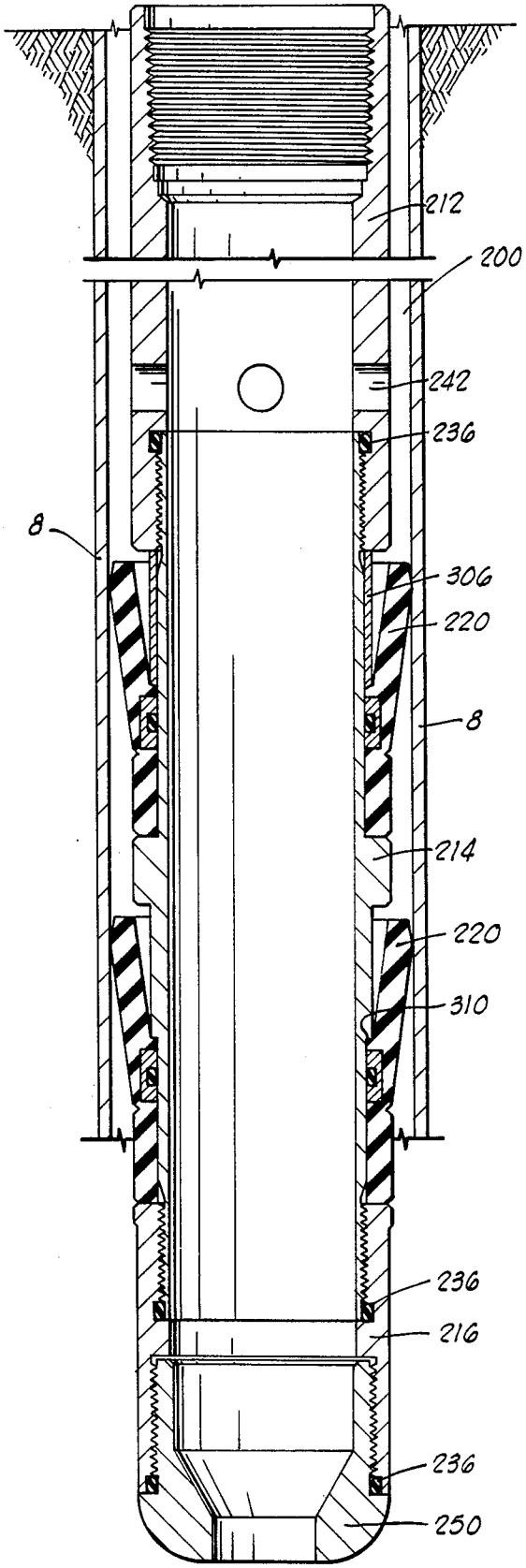
FIG. 2 is a cross-sectional view of the cup type formation packer shoe of the present invention for use with tubing.

Referring to FIG. 2, a tubing cup type formation packer shoe 200 for use with tubing in well cementing operations is shown in its preferred embodiment.

The tubing cup type formation packer shoe 200 comprises upper adapter 212, cup housing 214, lower adapter 216 and cup 220, apertures 242 and annular recess seal 236.

The tubing cup type formation packer shoe 200 is similar to the shoe 10 described before except that is does not contain a landing nipple, uses an externally threaded guide nose 250, or float shoe secured to the lower adapter 216 and only uses an upper cup spacer 306 on the cup housing 214 to retain the upper cup 220 thereon while the lower cup 220 is retained by annular shoulder 310 on cup housing 214.

Figure 3:
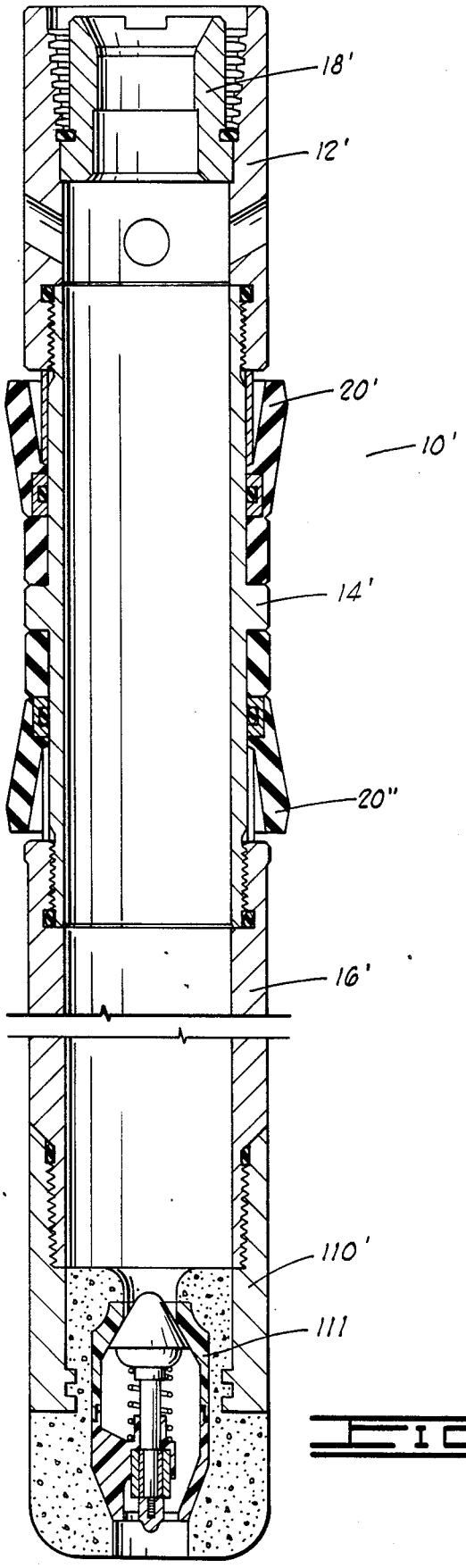
FIG. 3 is a cross-sectional view of the cup type formation packer shoe of the present invention for use in cementing a smaller diameter string of casing within a larger diameter string of casing with the cup type formation packer shoe having the packer cups oriented to hold fluid pressure from above and below the packer shoe.

Referring to FIG. 3, a modified cup type formation packer shoe 10' is shown having the upper packer cup 20' oriented in a first direction on the cup housing 14' and the lower packer cup 20'' oriented in another direction on the cup housing 14' so that the packer shoe 10' will hold fluid pressure from above and below the packer shoe 10'. In this instance, the cup type formation packer shoe 10' has a float shoe 110' secured thereto, the float shoe 110' having a check valve 111 therein to prevent the flow of fluids therein from below.

OPERATION OF THE INVENTION

Referring again to FIG. 1, the operation of the cup type formation packer shoe 10 of the present invention in cementing a smaller diameter string of casing inside a larger diameter string of casing will be set forth.

The upper adapter 12 of the cup type formation packer 10 is secured to the casing string to be cemented in the well and then run in the well. After a ball, shown in broken lines, has been landed on ball seat 114 of guide shoe 110, cement can be displaced down the new casing through holes 42 in the upper adapter 12 of the cup type formation packer 10 into the annulus formed between the old casing previously cemented into the well bore and the new casing to be cemented into the old casing.

The cement being pumped down the new casing, out the holes 42 in upper adapter 12 of cup type formation packer shoe 10 and into the annulus between the old and new casing, is followed by a latch-down plug (not shown) which latches into landing nipple 18 in the upper adapter 12 thereby preventing the upward flow of cement back into the new casing being cemented in place. At this time, and during the displacement of the cement into the annulus between the old and new casing in the well bore, the packer cups 20 are forced into sealing engagement with the old casing previously cemented in the well bore and support the column of cement placed in the annulus between the old and new casing thereby preventing the flow of the cement downwardly past the cups 20 and the packer shoe 10.

Referring to FIG. 2, the tubing cup type formation packer shoe 200, is used in similar manner and includes a plug and landing nipple (not shown) in the same location as in the preferred embodiment shown if FIG. 1.

It will be appreciated by those skilled in the art that changes may be made in the cup type formation packer shoe of the present invention which come within the scope of the invention.

Such as the lower adapter may be combined with the cup housing into a single member where the lower cup is retained on the cup housing by means of a threaded member engaging a threaded portion of the exterior of the cup housing.

Having thus described my invention, I claim:

1. A cup type formation packer shoe for cementing a smaller diameter casing or tubing in existing casing cemented in a well bore, said cup type formation packer shoe comprising:

a unitary upper adapter, threadedly engaged to said smaller diameter tubing, said upper adapter including a plurality of holes therethrough;

an elongated cylindrical cup housing having one end thereof secured to the upper adapter, said cup housing including a substantially cylindrical outer surface having a first and second annular shoulder extending outwardly therefrom, said first annular shoulder oriented in a direction towards said upper adapter and said second annular shoulder oriented in a direction opposite said first annular shoulder;

a substantially cylindrical lower adapter having an outside diameter such that when one end of said lower adapter is secured to the other end of the cup housing, a third annular shoulder is formed being oriented towards said upper adapter;

first and second elastomeric packer cups, retained on the cup housing, including a substantially unrestricted self supporting lip portion for sealingly engaging said existing casing in said well bore during cementing operations to cement said casing or tubing in said existing casing, said first and second packer cups including a base portion, opposite said lip portion, having an exterior end thereof, such that the exterior end of said first packer cup abuts said first annular shoulder and the exterior end of said second packer cup abuts said third annular shoulder, said first and third annular shoulders thereby providing support to said first and second packer cups respectively;

annular reinforcement means, embedded within said base portion, for providing reinforcing annular support to said packer cups by rigidly retaining said base portion adjacent said cup housing; and a landing nipple secured within the upper adapter.

2. The cup type formation packer shoe of claim 1 wherein:

the landing nipple is threaded within the upper adapter by means of a ring.

3. A cup type formation packer shoe for cementing a smaller diameter casing or tubing in existing casing cemented in a well bore, said cup type formation packer shoe comprising:

a unitary upper adapter, threadedly engaged to said smaller diameter tubing, said upper adapter including a plurality of holes therethrough;

an elongated cylindrical cup housing having one end thereof secured to the upper adapter, said cup housing including a substantially cylindrical outer surface having a first and second annular shoulder extending outwardly therefrom, said first annular shoulder oriented in a direction towards said upper adapter and said second annular shoulder oriented in a direction opposite said first annular shoulder;

a substantially cylindrical lower adapter having an outside diameter such that when one end of said lower adapter is secured to the other end of the cup housing, a third annular shoulder is formed being oriented towards said upper adapter;

first and second elastomeric packer cups, retained on the cup housing, including a substantially unrestricted self supporting lip portion for sealingly engaging said existing casing in said well bore during cementing operations to cement said casing or tubing in said existing casing, said first and second packer cups including a base portion, opposite said lip portion, having an exterior end thereof, such that the exterior end of said first packer cups abuts said first annular shoulder and the exterior end of said second packer cup abuts said third annular shoulder, said first and third annular shoulders thereby providing support to said first and second packer cups respectively;

annular reinforcement means, embedded completely within said base portion, for providing reinforcing annular support to said packer cups by rigidly retaining said base portion adjacent to said cup housing; and a float shoe secured to the other end of the lower adapter.

4. A cup type formation packer shoe for cementing a smaller diameter casing or tubing in existing casing cemented in a well bore, said cup type formation packer shoe comprising:

a unitary upper adapter, threadedly engaged to said smaller diameter tubing, said upper adapter including a plurality of holes therethrough;

an elongated cylindrical cup housing having one end thereof secured to the upper adapter, said cup housing including a substantially cylindrical outer surface having a first and second annular shoulder extending outwardly therefrom, said first annular shoulder oriented in a direction towards said upper adapter and said second annular shoulder oriented in a direction opposite said first annular shoulder;

a substantially cylindrical lower adapter having an outside diameter such that when one end of said lower adapter is secured to the other end of the cup housing, a third annular shoulder is formed being oriented towards said upper adapter;

first and second elastomeric packer cups, retained on the cup housing, including a substantially unrestricted self supporting lip portion for sealingly engaging said existing casing in said well bore during cementing operations to cement said casing or tubing in said existing casing, said first and second packer cups including a base portion, opposite said lip portion, having an exterior end thereof, such that the exterior end of said first packer cup abuts said first annular shoulder and the exterior end of said second packer cup abuts said third annular shoulder, said first and third annular shoulders thereby providing support to said first and second packer cups respectively;

annular reinforcement means, embedded within said base portion, for providing reinforcing annular support to said packer cups by rigidly retaining said base portion adjacent said cup housing; and a guide shoe secured to the other end of the lower adapter.

5. A cup type formation packer shoe for cementing a small diameter casing or tubing in existing casing cemented in a well bore, said cup type formation packer shoe comprising:

a unitary upper adapter, threadedly engaged to said smaller diameter tubing, said upper adapter including a plurality of holes therethrough;

an elongated cylindrical cup housing having one end thereof secured to the upper adapter, said cup housing including a substantially cylindrical outer surface having a first and second annular shoulder extending outwardly therefrom, said first annular shoulder oriented in a direction towards said upper adapter and said second annular shoulder oriented in a direction opposite said first annular shoulder;

a substantially cylindrical lower adapter having an outside diameter such that when one end of said lower adapter is secured to the other end of the cup housing, a third annular shoulder is formed being oriented towards said upper adapter;

first and second elastomeric packer cups, retained on the cup housing, including a substantially unrestricted self supporting lip portion for sealingly engaging said existing casing in said well bore in response to displacement of cement through said holes of said upper adapter during cementing operations to cement said casing or tubing in said existing casing so that said packer cups support the resulting column of cement placed in an annulus defined between said casing or tubing and said existing casing, said first and second packer cups including a base portion, opposite said lip portion, having an exterior end thereof, said first packer cup oriented on said cup housing such that the exterior end of said first packer cup abuts said first annular shoulder, and said second packer cup oriented in a direction on said cup housing opposite said first packer cup such that the exterior end of said second packer cup abuts said second annular shoulder, said first and second annular shoulders thereby providing support to said first and second packer cups respectively;

annular reinforcement means, embedded within said base portion, for providing reinforcing annular support to said packer cups by rigidly retaining said base portion adjacent said cup housing; and a landing nipple secured within the upper adapter.

6. The cup type formation packer shoe of claim 5 wherein:

the landing nipple is threaded within the upper adapter by means of a ring.

7. A cup type formation packer shoe for cementing a small diameter casing or tubing in existing casing cemented in a well bore, said cup type formation packer shoe comprising:

a unitary upper adapter, threadedly engaged to said smaller diameter tubing, said upper adapter including a plurality of holes therethrough;

an elongated cylindrical cup housing having one end thereof secured to the upper adapter, said cup housing including a substantially cylindrical outer surface having a first and second annular shoulder extending outwardly therefrom, said first annular shoulder oriented in a direction towards said upper adapter and said second annular shoulder oriented in a direction opposite said first annular shoulder;

a substantially cylindrical lower adapter having an outside diameter such that when one of said lower adapter is secured to the other end of the cup housing, a third annular shoulder is formed being oriented towards said upper adapter;

first and second elastomeric packer cups, retained on the cup housing, including a substantially unrestricted self supporting lip portion for sealingly engaging said existing casing in said well bore in response to displacement of cement through said holes of said upper adapter during cementing operations to cement said casing or tubing in said existing casing so that said packer cups support the resulting column of cement placed in an annulus defined between said casing or tubing and said existing casing, said first and second packer cups including a base portion, opposite said lip portion, having an exterior end thereof, said first packer cup oriented on said cup housing such that the exterior end of said first packer cup abuts said first annular shoulder, and said second packer cup oriented in a direction on said cup housing opposite said first packer cup such that the exterior end of said second packer cup abuts said second annular shoulder, said first and second annular shoulders thereby providing support to said first and second packer cups respectively;

annular reinforcement means, embedded within said base portion, for providing reinforcing annular support to said packer cups by rigidly retaining said base portion adjacent said cup housing; and a float shoe secured to the other end of the lower adapter.

8. A cup type formation packer shoe for cementing a small diameter casing or tubing in existing casing cemented in a well bore, said cup type formation packer shoe comprising:

a unitary upper adapter, threadedly engaged to said smaller diameter tubing, said upper adapter including a plurality of holes therethrough;

an elongated cylindrical cup housing having one end thereof secured to the upper adapter, said cup housing including a substantially cylindrical outer surface having a first and second annular shoulder extending outwardly therefrom, said first annular shoulder oriented in a direction towards said upper adapter and said second annular shoulder oriented in a direction opposite said first annular shoulder;

a substantially cylindrical lower adapter having an outside diameter such that when one end of said lower adapter is secured to the other end of the cup housing, a third annular shoulder is formed being oriented towards said upper adapter;

first and second elastomeric packer cups, retained on the cup housing, including a substantially unrestricted self supporting lip portion for sealingly engaging said existing casing in said well bore in response to displacement of cement through said holes of said upper adapter during cementing operations to cement said casing or tubing in said existing casing so that said packer cups support the resulting column of cement placed in an annulus defined between said casing or tubing and said existing casing, said first and second packer cups including a base portion, opposite said lip portion, having an exterior end thereof, said first packer cup oriented on said cup housing such that the exterior end of said first packer cup abuts said first annular shoulder, and said second packer cup oriented in a direction on said cup housing opposite said first packer cup such that the exterior end of said second packer cup abuts said second annular shoulder, said first and second annular shoulders thereby providing support to said first and second packer cups respectively;

annular reinforcement means, embedded within said base portion, for providing reinforcing annular support to said packer cups by rigidly retaining said base portion adjacent said cup housing; and a guide shoe secured to the other end of the lower adapter.

9. A cup type formation packer shoe for cementing a small diameter casing or tubing in existing casing cemented in a well bore, said cup type formation packer shoe comprising:

a single-body upper adapter member, having a threaded bore for threadedly engaging the small diameter casing or tubing, said upper adapter member including a plurality of holes therethrough;

a single-body cup housing member having one end thereof connected to said upper adapter member, said cup housing member including a substantially cylindrical outer surface having first and second annular shoulders extending outwardly therefrom, said first annular shoulder oriented in a direction towards said upper adapter member and said second annular shoulder oriented in a direction opposite said first annular shoulder;

a single-body lower adapter member having one end thereof connected to said cup housing member so that a third annular shoulder is formed being oriented towards said upper adapter member;

first and second elastomeric packer cups, each of said packer cups including a substantially unrestricted self supporting lip portion for sealingly engaging the existing casing in the well bore in response to displacement of cement through said holes of said upper adapter member during cementing operations to cement the casing or tubing in the existing casing so that said packer cups support the resulting column of cement placed in an annulus defined between the casing or tubing and the existing casing, each of said packer cups further including a base portion, opposite said lip portion, having an exterior end thereof, said packer cups retained on said cup housing member so that the exterior end of said first packer cup abuts said first annular shoulder and the exterior end of said second packer cup abuts a selected one of said second or third annular shoulders;

annular reinforcement means, embedded within said base portions of said packer cups, for providing reinforcing annular support to said packer cups by rigidly retaining said base portions adjacent said cup housing member; and a landing nipple secured within said upper adapter member.

10. The cup type formation packer shoe of claim 9 wherein said landing nipple is threaded within said threaded bore of said upper adapter member and has a resilient seal therein.

11. The cup type formation packer shoe of claim 9 further comprising a float shoe secured to the other end of said lower adapter member.

12. The cup type formation packer shoe of claim 9 further comprising a guide shoe secured to the other end of said lower adapter member.

* * * * *